US005307040A

United States Patent [19]

Lytollis

[11] Patent Number: 5,307,040

[45] Date of Patent: Apr. 26, 1994

[54] TRANSFORMER WITH CLOSED CONDUCTIVE LOOP

[75] Inventor: Barry J. Lytollis, St. Albans, England

[73] Assignee: Measurement Technology Limited, Bedfordshire, England

[21] Appl. No.: 889,538

[22] Filed: May 27, 1992

[30] Foreign Application Priority Data

May 29, 1991 [GB] United Kingdom ..... 9111535

[51] Int. Cl.[5] ..... H01F 27/02; H01F 27/30

[52] U.S. Cl. ..... 336/73; 336/92; 336/174

[58] Field of Search ..... 336/90, 92, 96, 73, 336/174, 175

[56] References Cited

U.S. PATENT DOCUMENTS

| | | | |
|---|---|---|---|
| 2,412,345 | 12/1946 | Lindenblad | 336/175 |
| 2,829,338 | 4/1958 | Lord | 336/73 |
| 3,020,502 | 2/1962 | Graham | 336/73 |
| 3,222,625 | 12/1965 | Ledocq | 336/174 |
| 3,431,487 | 3/1969 | Savage | 336/73 |
| 3,742,408 | 6/1973 | Jaeger | 336/174 |
| 3,959,761 | 5/1976 | Groul | 336/96 |
| 4,117,437 | 9/1978 | Ottesen | 336/174 |

FOREIGN PATENT DOCUMENTS

| | | |
|---|---|---|
| 0387441A1 | 9/1990 | European Pat. Off. . |
| 3817890A1 | 12/1988 | Fed. Rep. of Germany . |
| 619930 | 3/1949 | United Kingdom . |
| 659801 | 10/1951 | United Kingdom . |
| 776305 | 6/1957 | United Kingdom . |
| 2000384 | 1/1979 | United Kingdom . |

*Primary Examiner*—Thomas J. Kozma
*Attorney, Agent, or Firm*—Seidel, Gonda, Lavorgna & Monaco

[57] ABSTRACT

A transformer, particularly for use in intrinsically safe systems, has separate first and second magnetic cores mounted in wells in a one-piece elastics housing which serves both as a housing and to electrically segregate the cores. Passing through the housing and through the cores is a wire loop which is turned back and joined outside the housing so as to link the two cores electromagnetically. The cores are preferably toroidal cores carrying windings.

11 Claims, 1 Drawing Sheet

TRANSFORMER WITH CLOSED CONDUCTIVE LOOP

FIELD OF THE INVENTION

This invention relates generally to transformers, and is particularly concerned with transformers which are intended for use in intrinsically-safe systems in order to isolate control systems which are in non-hazardous areas from wiring and other equipment which is in hazardous areas, where there may be for example a flammable atmosphere. An intrinsically-safe system is one which provides protection against explosion in an environment containing gases or vapours by limiting the electrical power so that the energy of any spark or hot surface is insufficient to cause ignition.

Intrinsically-safe transformers are known. Such transformers achieve the necessary segregation by the use cf heavy insulation of the windings on a common magnetic core. The requirements for intrinsic safety demand that this insulation is 1 mm thick plastics material, which means that the transformer is quite bulky and typically involves the use of a number of plastics mouldings which can be quite complex.

SUMMARY OF THE INVENTION

It is an object of the present invention to provide a transformer which is compact, which uses relatively few parts and which is relatively cheap to manufacture.

This is achieved in accordance with the invention by using two magnetic cores which are segregated from each other by insulating means which also forms a housing for the two cores. The two cores are electromagnetically linked by a suitably insulated electrical conductor means.

In accordance with the invention there is provided a transformer comprising a first magnetic core; primary winding means on said first core; a second magnetic core spaced from and separate from said first core; secondary winding means on said second core; housing means of electrically insulating material both receiving said cores and winding means and also segregating said cores one from the other; and electrical conductor means electromagnetically to link said first and second cores.

A further advantage of this design is that the windings on each core do not need any special insulation.

BRIEF DESCRIPTION OF THE DRAWINGS

In order that the invention may be more fully understood, one presently preferred embodiment of intrinsically safe transformer will now be described by way of example and with reference to the accompanying drawings, in which.

DESCRIPTION OF THE PREFERRED EMBODIMENT

Figure 4:
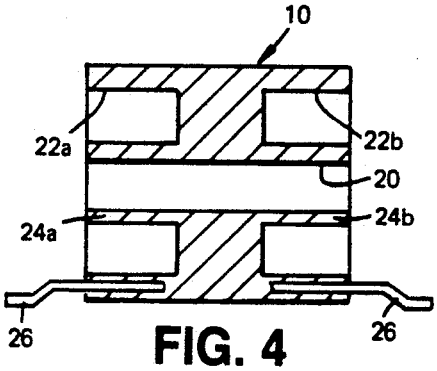
FIG. 4 is a longitudinal sectional view through the housing only of the transformer of FIGS. 1 to 3.

As shown in the drawings, the intrinsically-safe transformer of the present invention comprises a housing 10 of electrically insulating, plastics material, preferably formed as a one-piece moulding. The plastics material housing may include for example of the order of 30% by volume of glass, for example as fibres. The housing 10 comprises a base 12, side walls 13, 14, and a top 16 which is connected to the side walls 13, 14 by sloping parts 17, 18. As shown most clearly in FIG. 4, the housing is essentially a block of material, suitably recessed. A cylindrical bore 20 is formed longitudinally therethrough. A recess **22*a*, 22*b* is provided at each end of the housing, thereby to define, at each end of the housing, a substantially annular well around respective annular spigots 24*a*, 24*b*. The central portion of the housing between the two wells is solid apart from the bore 20 therethrough. In a typical embodiment, the length dimension of the central housing portion is approximately equal to the depth of each of the wells 22*a*, 22*b***. The length of this central portion is important to achieve segregation of the cores.

The housing 10 is provided at each end and projecting longitudinally outwards from the base 12 of the housing with a plurality of terminals 26. These terminals may be metal as illustrated or other means. In one embodiment the terminals are formed in plastic, electrical connection being achieved by wrapping the winding terminations around the terminals. In the illustrated example five such metal terminals 26 are provided at each end. They extend parallel to each other and are spaced typically with a pitch spacing of 2 mm. The terminals 26 are preferably moulded into the housing 10.

Within each well **22*a*, 22*b* in the housing is positioned a respective, separate toroidal magnetic core 28*a*, 28*b*. Each core 28*a*, 28*b* is made of laminated iron or ferrite. The housing spigot 24*a*, 24*b* extends through the central hole in the torus. Each core 28*a*, 28*b* carries windings, shown only at 30 for core 28*a* in the drawings. The windings on one core constitute the primary winding of the transformer and the windings on the other core constitute the secondary winding of the transformer. In use, energy of an alternating current in the primary winding is transferred as alternating current in the secondary winding through electromagnetic induction. Tapping points on the windings are connected to individual ones of the terminals 26 as indicated by the wire ends 32 in FIG. 1. The windings 30** on each core do not need any special insulation.

It will therefore be appreciated that the single plastics moulding 10 serves both as a housing and also as a means to segregate the two toroidal magnetic cores.

Figure 1:
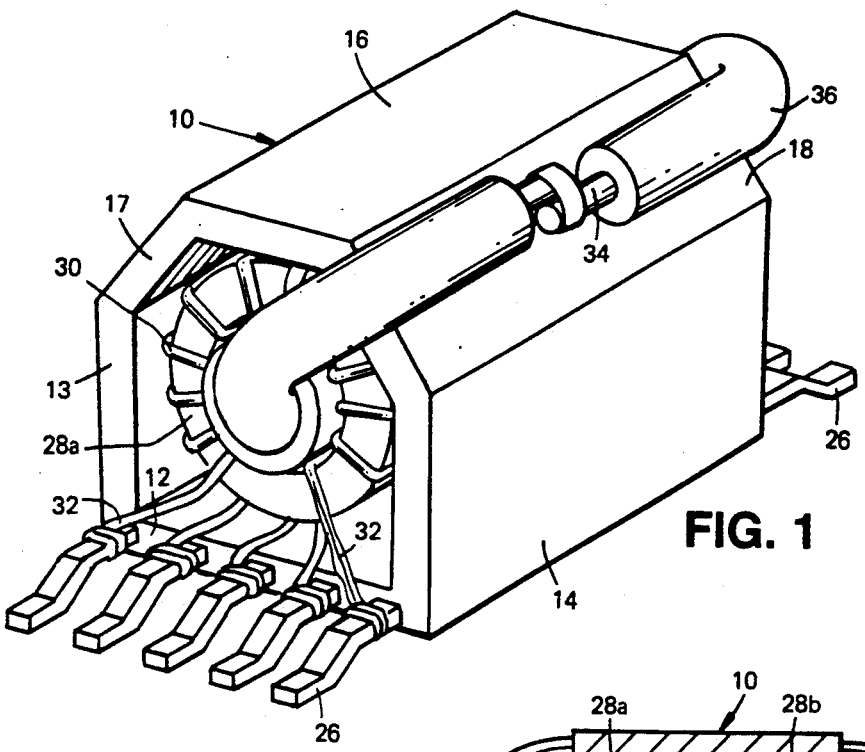
FIG. 1 is a perspective view of the complete transformer.
Figure 3:
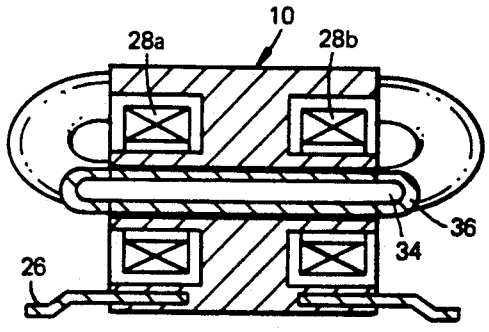
FIG. 3 is a sectional view taken along the line III—III of FIG. 2.
Figure 2:
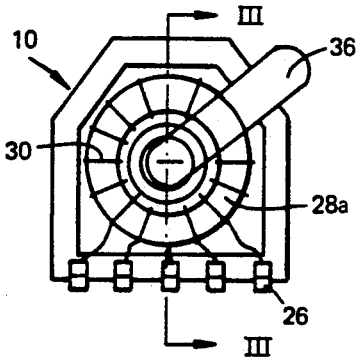
FIG. 2 is an end view of the transformer of FIG. 1.

A metal link wire 34 extends coaxially through the bore 20 in the housing and is turned back around the outside of the housing where the two ends of the wire are connected together in electrically conductive relationship, as shown most clearly in FIG. 1. The single turn of wire 34 electromagnetically links the two cores **28*a*, 28*b*. The link wire 34 is provided with an electrically insulating sleeve 36 throughout its length apart from the short cross-over portion where the two wire ends overlap. This insulating sleeve 36 is preferably at least 0.5 mm thick. The wire 34** is preferably tinned copper wire, sleeved in silicone rubber, with the ends soldered, crimped or wirewrap terminated.

The resulting transformer, which is especially suitable for use in intrinsically safe systems, is compact, uses fewer parts and is relatively inexpensive to manufacture.

As many and varied modifications of the subject matter of this invention will become apparent to those skilled in the art from the detailed description given above, it is to be understood that the present invention is limited only as provided in the claims appended hereto.

I claim:

1. A transformer comprising:

a first magnetic core;

primary winding means on said first core;

a second magnetic core spaced from and separate from said first core;

secondary winding means on said second core;

housing means of electrically insulating material both receiving said cores and winding means and also segregating said cores one from the other; and electrical conductor means electromagnetically linking said first and second cores, wherein the electrical conductor means comprises a length of wire extending through the housing means and thereby through said first and second cores in spaced insulating relationship thereto, the wire extending outside the housing means to complete a closed conductive loop.

2. A transformer according to claim 1, in which the housing means comprises a block of electrically insulating material having a longitudinal axis and a pair of recesses, oppositely disposed one at each end of the block, with a central portion of insulating material therebetween, the recesses receiving the respective cores and winding means.

3. A transformer according to claim 2, in which each recess is an annular well about a central spigot, the block having a longitudinally extending bore centrally therethrough which passes through each spigot and through the central portion of the block.

4. A transformer according to claim 1, which includes a sheath of electrically insulating material encompassing the wire.

5. A transformer comprising:

a first magnetic core;

primary winding means on said first core;

a second magnetic core spaced from and separate from said first core;

secondary winding means on said second core;

housing means both receiving said cores and winding means and also segregating said cores one from the other; and electrical conductor means electromagnetically linking said first and second cores, the housing means comprising a block of electrically insulating material having a longitudinal axis and a pair of recesses, oppositely disposed one at each end of the block, with a central portion of insulating material therebetween, the recesses receiving the respective cores and winding means, in which each recess is an annular well about a central spigot, the block having a longitudinally extending bore centrally therethrough which passes through each spigot and through the central portion of the block, the electrical conductor means comprising a length of wire extending through the central bore in the housing means and thereby through said first and second cores in insulating relationship thereto, the wire extending outside the housing means to complete a closed conductive loop.

6. A transformer according to clan 5, which includes a sheath of electrically insulating material encompassing the wire,.

7. A transformer according to claim 1, in which each of said cores is a toroidal core, each core being retained on a spigot of the housing means within a well in the housing means.

8. A transformer according to claim 7, which includes electrically conductive terminals moulded into the housing means, said primary and secondary winding means being connected to respective ones of said terminals.

9. A transformer according to claim 7, which includes non-conductive terminals, said primary and secondary winding means being terminated by being wrapped around said terminals.

10. A transformer according to claim 2, in which the axial thickness of the central portion of the housing means is about equal to the axial dimension of each of said recesses.

11. A transformer according to claim 1, in which the housing means is a one-piece plastics moulding.

* * * * *